US006457445B1

(12) United States Patent
Sugawara

(10) Patent No.: US 6,457,445 B1
(45) Date of Patent: Oct. 1, 2002

(54) VALVE LIFT CONTROL DEVICE

(75) Inventor: Masafumi Sugawara, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/030,047

(22) PCT Filed: May 23, 2000

(86) PCT No.: PCT/JP00/03296

§ 371 (c)(1),
(2), (4) Date: Jan. 7, 2002

(87) PCT Pub. No.: WO01/90538

PCT Pub. Date: Nov. 29, 2001

(51) Int. Cl.[7] ..... F01L 13/00; F01L 1/14
(52) U.S. Cl. ..... 123/90.16; 123/90.5
(58) Field of Search ..... 123/90.15, 90.16, 123/90.17, 90.48, 90.5; 74/569

(56) References Cited

U.S. PATENT DOCUMENTS 5,603,294 A * 2/1997 Kawai ..... 123/90.16
5,743,226 A * 4/1998 Tohdoh et al. ..... 123/90.16
6,257,185 B1 * 7/2001 Groh et al. ..... 123/90.16
6,293,239 B1 * 9/2001 Herbst ..... 123/90.16

FOREIGN PATENT DOCUMENTS

JP 7-109910 4/1995
JP 10-141030 5/1998

* cited by examiner

*Primary Examiner*—Weilun Lo
(74) *Attorney, Agent, or Firm*—Sughrue Mion, PLLC

(57) ABSTRACT

A valve lift control device includes an inner tappet biased toward a low-lift cam pertinent to the opening and the closing of a valve in a low-lift mode acting as one of cams which are arranged on a camshaft being driven rotationally in synchronization with a rotation of an internal combustion engine; an outer tappet arranged outside of the inner tappet and biased toward a high-lift cam pertinent to the opening and the closing of the valve in a high-lift mode among the plurality of cams; and a rotational member being arranged rotationally in a peripheral direction of the inner and outer tappets and including at least one projection member being outwardly projected from a perimeter of the inner tappet and an engagement section engaging with the projection member. The valve lift control device blocks or allows a relative sliding of the inner and outer tappets in an axial direction of the tappet due to rotation of the rotational member in a required range.

17 Claims, 15 Drawing Sheets

VALVE LIFT CONTROL DEVICE

TECHNICAL FIELD

The invention relates to a valve lift control device, which controls a valve lift according to operating conditions of an internal combustion engine such as an engine when an intake valve or an exhaust valve of the engine is opened and closed due to a cam via a tappet.

BACKGROUND ART

Generally, with a valve operating system of the internal combustion engine, both of the valve lift and an angular aperture are reduce during a low-rpm condition. In this way, the velocity of a mixed gas is increased to improve combustion efficiency. On the other hand, both of the valve lift and an overlap are increased during a high-rpm condition to improve a suction efficiency through the use of an exhaust inertial effect. In this way, it results in enhancement of fuel economy and improvement of power of the internal combustion engines.

With the valve operating system as discussed above, the valve lift control device used in conjunction with a valve timing control device is disclosed in JP-A-1998/507242, for example.

The valve lift control device includes a plurality of cams arranged on a camshaft being driven rotationally in synchronization with a rotation of an internal combustion engine, an inner tappet movable reciprocally in an axial direction of a valve rod pursuant to a cam profile of a low-lift cam pertinent to the opening and the closing of the valve during a low-rpm condition (equivalent of a low-lift mode) of the above cams, an outer tappet arranged outside of the inner tappet and movable reciprocally in an axial direction of a valve rod pursuant to a cam profile of a high-lift cam pertinent to the opening and the closing of the valve during a high-rpm condition (equivalent of a high-lift mode), and a movable member arranged in the inner tappet and movable in a radial direction of the inner tappet.

The movable member is moved outwardly in a radial direction of the inner tappet due to a hydraulic pressure, which is supplied to a central section of the inner tappet in the high-lift mode, to engage whith a recess formed at an inner peripheral section of the outer tappet. As a result, both tappets are integrated. The hydraulic pressure is reduced in the low-lift mode, and the movable member is moved inwardly in the radial direction of the inner tappet due to a biasing means such as spring and so on to be disconnected from the recess of the outer tappet. As a result, both tappets are separated.

With the conventional valve lift control device, a hydraulic pressure necessary to engage the movable member with the recess of the outer tappet must be however supplied to the central section of the inner tappet. The hydraulic system is complicated in construction, and causes a disturbance of operation.

Moreover, JP-A-1998/141030 discloses the same technical information as the gazette described above.

The invention was made to solve the foregoing problems, and an object of the invention is to provide a valve lift control device having a simple structure to ensure good operating reliability.

DISCLOSURE OF THE INVENTION

A valve lift control device according to the invention comprises an inner tappet biased toward a low-lift cam pertinent to the opening and the closing of a valve in the low-lift mode acting as one of cams which are arranged on a camshaft being driven rotationally in synchronization with a rotation of an internal combustion engine; an outer tappet arranged outside of the inner tappet and biased toward a high-lift cam pertinent to the opening and the closing of the valve in the high-lift mode among the plurality of cams; and a rotational member being arranged rotationally in a peripheral direction of the inner and outer tappets and including at least one projection member being outwardly projected from a perimeter of the inner tappet and an engagement section engaging with the projection member, characterized in that a relative sliding of the inner and outer tappets in an axial direction of the tappet is blocked or allowed due to a rotation of the rotational member in a required range. In this way, the valve lift control device is simply constituted as compared with the conventional valve lift control device, and facilitates selection between a valve lift during a low-rpm condition and a valve lift during a high-rpm condition. It is therefore possible to ensure good operating reliability and good stability in each parts of the device.

With the above arrangement, the valve lift control device is characterized in that the projection member is a rod-shaped member projected from the outer periphery of the inner tappet. In this way, since the rod-shaped member acting as the projection member is projected from the outer periphery of the inner tappet, it is possible to ensure that the rod-shaped member is engaged with and disengaged from an engagement section of the rotational member.

With the above arrangement, the valve lift control device is characterized in that the rod-shaped member passes through the interior of the inner tappet in a radial direction, and that at least one end of the rod-shaped member is projected outwardly from the perimeter of the inner tappet in the radial direction. In this way, since the rod-shaped member acting as the projection member is projected outwardly from the outer periphery of the inner tappet in the radial direction, it is possible to ensure that the rod-shaped member is engaged with and disengaged from an engagement section of the rotational member.

With the above arrangement, the valve lift control device is characterized in that the rotational member is movable in one direction in two peripheral directions of the inner and outer tappets, respectively, due to a hydraulic pressure. In this way, it is possible to ensure moving smoothly the rotational member to lock the rod-shaped member.

With the above arrangement, the valve lift control device is characterized in that the rotational member is movable in the other direction in two peripheral directions of the inner and outer tappets, respectively, due to a mechanical biasing force. In this way, it is possible to ensure moving smoothly the rotational member to release a lock of the rod-shaped member.

With the above arrangement, the valve lift control device is characterized in that the rotational member is movable in both peripheral directions of the inner and outer tappets, respectively, due to a hydraulic pressure. In this way, it is possible to ensure moving smoothly the rotational member to perform a lock of the rod-shaped member and the release the lock.

With the above arrangement, the valve lift control device is characterized in that the rotational member has a recess, which is engaged with the projection member. In this way, when the lock of the projection member is released due to the rotational member, it is possible to ensure the relative sliding of the inner and outer tappets in an axial direction of the tappet within a stroke.

With the above arrangement, the valve lift control device is characterized in that the projection has a plane face acting as a contact face, which comes into contact with the rotational member. In this way, the rotational member can come into contact with the projection member with stability.

With the above arrangement, the valve lift control device is characterized in that at least one end of the projection member is projected outwardly from the outer periphery of the inner tappet in a radial direction, and is engaged with a groove formed at an inner face of a cylindrical aperture, which supports slidably the outer tappet, of a cylinder head in a sliding direction. In this way, it is possible to control a free rotation of the inner and outer tappets.

With the above arrangement, the valve lift control device is characterized in that an edge of a contact face, which comes into contact with the low-lift cam, of the inner tappet is arranged outside of an orbit of a cam profile of the low-lift cam, apart from the low-lift cam. In this way, since the low-lift cam is kept from contact with the edge of the contact face, which comes into contact with the low-lift cam, of the inner tappet, it is possible to ensure a smooth sliding of the low-lift cam with respect to the inner tappet.

With the above arrangement, the valve lift control device is characterized in that the rotational member has the shape of a sector, at least one thereof is arranged in a holder having a bobbin-shape, and is held rotationally in peripheral directions of the rotational member. In this way, since the rotational member having the shape of a sector can be rotated easily within the holder, it is possible to ensure a good hydraulic response.

With the above arrangement, the valve lift control device is characterized in that a stopper controlling a range allowing rotation of the rotational member is arranged at a portion of a groove of the bobbin-shaped holder. In this way, since the stopper controls the range allowing rotation of the rotational member, it is possible to control the relative sliding of the inner and outer tappets in the axial direction of the tappet with reliability.

With the above arrangement, the valve lift control device is characterized in that a torsion-spring, which biases the rotational member in one direction of peripheral directions of the inner and outer tappets, is provided. Thus, when rotation of the rotational member is performed due to a hydraulic pressure, and the hydraulic pressure is not supplied under abnormal conditions, the rotational member can be rotated due to a mechanical biasing force of the torsion-spring in a safety direction ensuring a relative position of the tappets.

With the above arrangement, the valve lift control device is characterized in that the inner tappet is provided with a slide-bearing member having a contact face, which comes into contact with the low-lift cam, of the inner tappet and allowing mating with and de-mating from the inner tappet. In this way, it is possible to ensure a smooth sliding of the low-lift cam with respect to the inner tappet.

With the above arrangement, the valve lift control device is characterized in that a rotational location control means is provided, controlling a relative rotational location between the slide-bearing member and the inner tappet. In this way, it is possible to prevent the inner tappet from a malfunction, which causes by the high-lift cam when the slide-bearing member differ from a standard to cross the orbit of the high-lift cam.

With the above arrangement, the valve lift control device is characterized in that the slide-bearing member covers with a portion of the outer tappet apart from a contact face, which comes into contact with the high-lift cam, of the outer tappet. In this way, it is possible to ensure a smooth sliding of the low-lift cam with respect to the inner tappet and a smooth sliding of the high-lift cam with respect to the outer tappet.

With the above arrangement, the valve lift control device is characterized in that the slide-bearing member is accommodated in a groove formed at a portion of the outer tappet apart from a contact face, which comes into contact with the high-lift cam, of the outer tappet, wherein a contact face of the slide-bearing member is flush with the contact face of the outer tappet. In this way, a base circle diameter of the high-lift cam can be identical to that of the low-lift cam, the cams being arranged on a camshaft.

A valve lift control device according to the invention comprises an inner tappet biased toward a low-lift cam pertinent to the opening and the closing of a valve in the low-lift mode acting as one of cams which are arranged on a camshaft being driven rotationally in synchronization with a rotation of an internal combustion engine; an outer tappet arranged outside of the inner tappet and biased toward a high-lift cam pertinent to the opening and the closing of the valve in the high-lift mode among the plurality of cams; a rod-shaped member allowing the relative sliding between the inner and outer tappets in an axial direction of the tappet within a stroke equivalent to a difference between a valve lift due to the low-lift cam and a valve lift due to the high-lift cam; a rotational member moving in one direction of peripheral directions of the inner and outer tappets to lock the rod-shaped member and accordingly to move integrally the inner and outer tappets in the axial direction thereof; and a hydraulic mechanism arranged outside of the inner tappet to allow the lock and release of the rod-shaped member due to the rotational member. In this way, it is not necessary to supply the hydraulic pressure to the internal of the inner tappet. Since the device can be simply constituted, it is possible to ensure good operating reliability and good stability in each parts of the device.

BEST MODES FOR CARRYING OUT THE INVENTION

To explain the invention more in detail, the best modes of carrying out the invention will be described with reference to the accompanying drawings.

Embodiment 1

Figure 1:
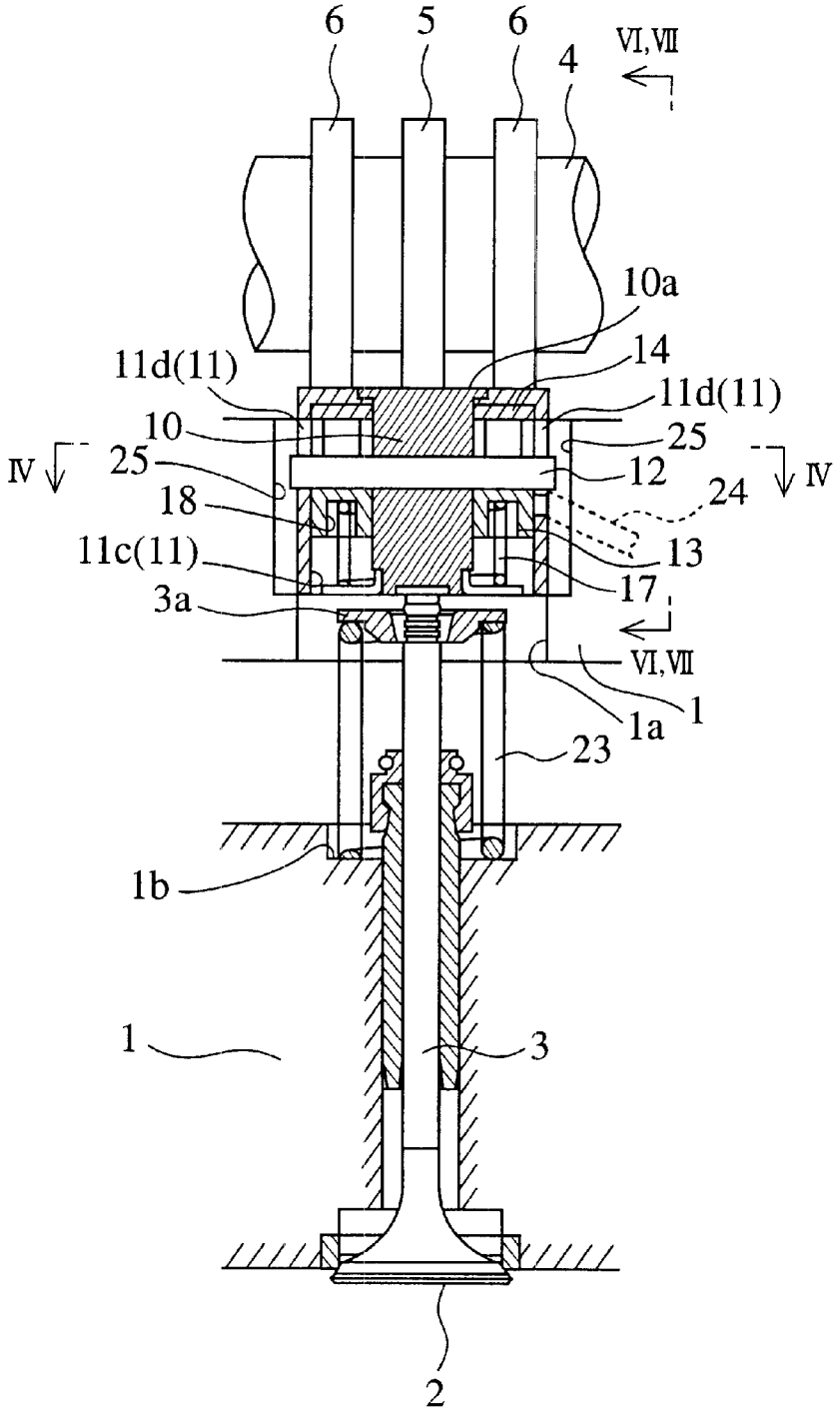
FIG. 1 is a longitudinal cross sectional view showing a relation of a cam and a tappet in a valve lift control device as embodiment 1 according to the invention when a base circle of the cam comes into contact with the tappet.
Figure 2:
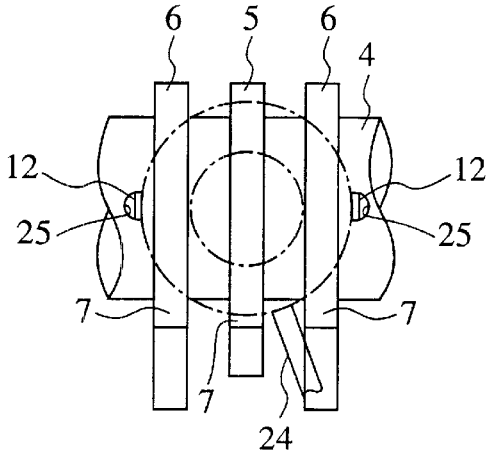
FIG. 2 is a plane view of the valve lift control device as shown in FIG. 1.
Figure 3:
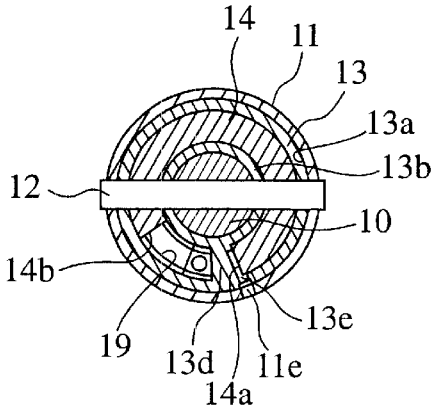
FIG. 3 is a cross sectional view taken along lines IV—IV of FIG. 1.
Figure 4:
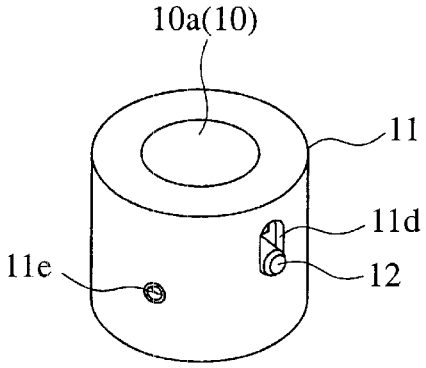
FIG. 4 is a perspective view showing the valve lift control device as shown in FIG. 1 to FIG. 3.
Figure 5:
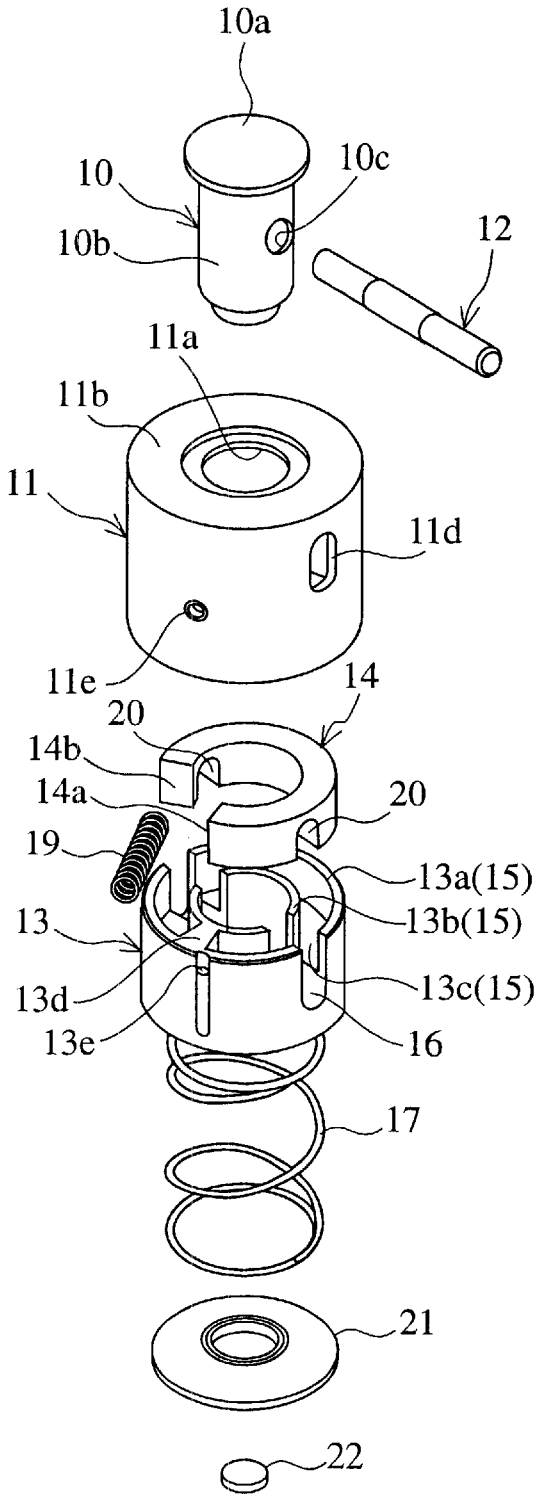
FIG. 5 is an exploded perspective view of FIG. 4.
Figure 6A:
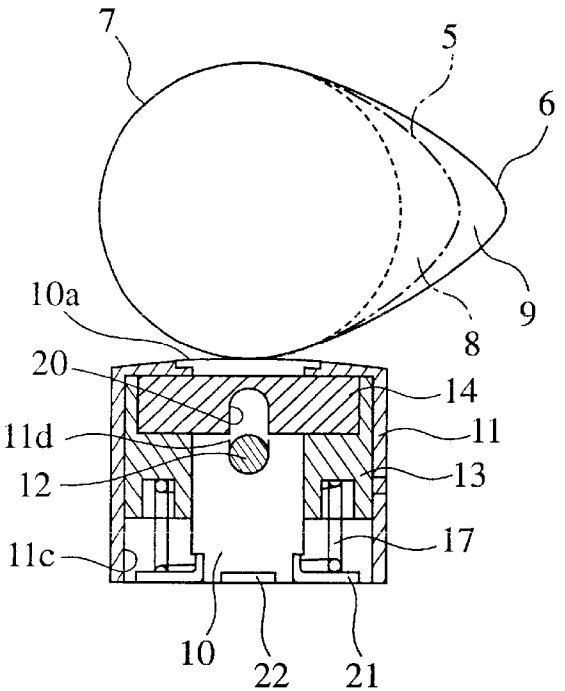
FIG. 6(*a*) to FIG. 6(*c*) and FIG. 7(*a*) to FIG. 7(*c*) are cross sectional views taken along lines VI—VI and VII—VII of FIG. 1, respectively, each showing a relative position between a cam in a low-lift mode and a tappet with time.
Figure 6B:
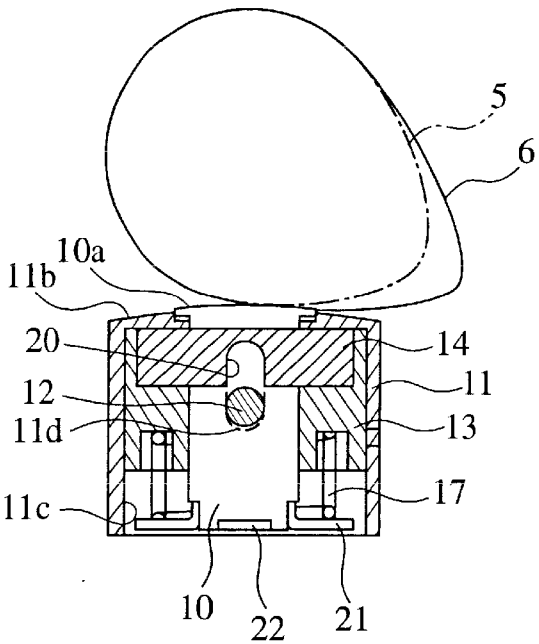
Figure 6C:
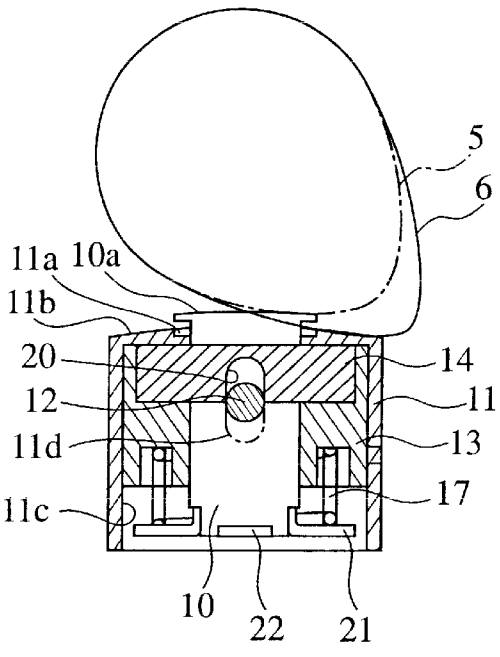
Figure 8:
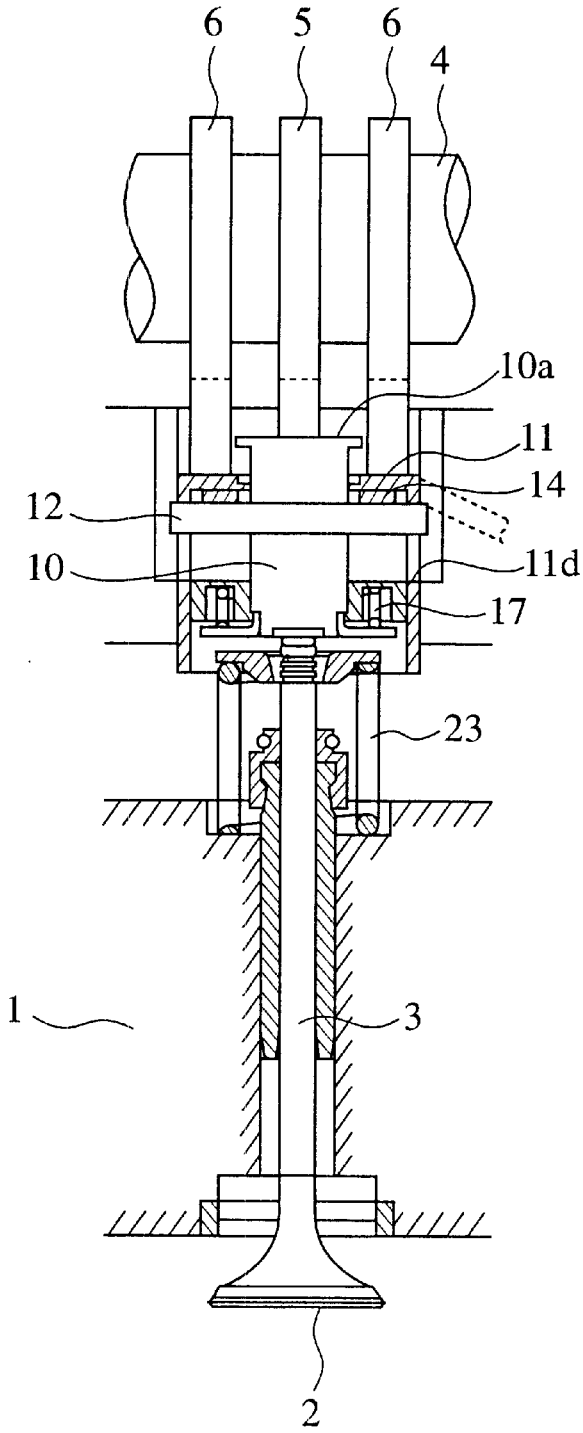
FIG. 8 is a longitudinal cross sectional view showing a valve-lifted state pursuant to a cam profile of a low-lift cam.
Figure 9:
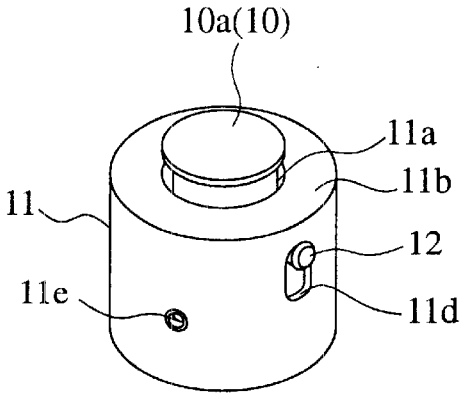
FIG. 9 is a perspective view showing the valve lift control device as shown in FIG. 8.
Figure 11:
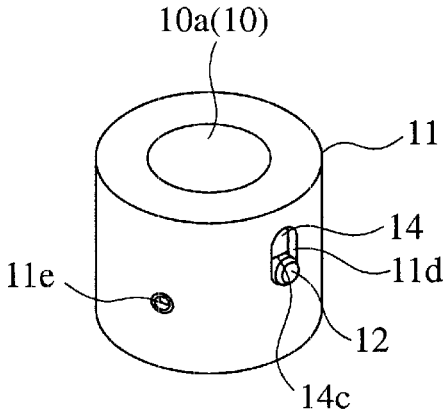
FIG. 11 is a perspective view showing the valve lift control device as shown in FIG. 10.
Figure 12:
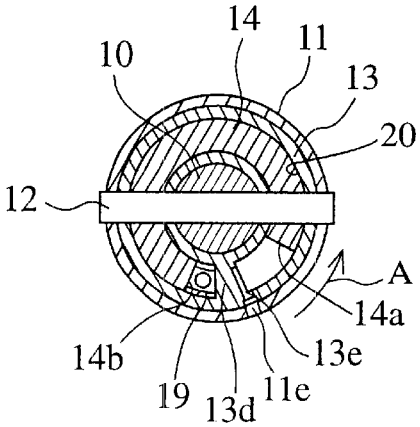
FIG. 12 is a cross sectional view taken along lines XII—XII of FIG. 10.
Figure 10:
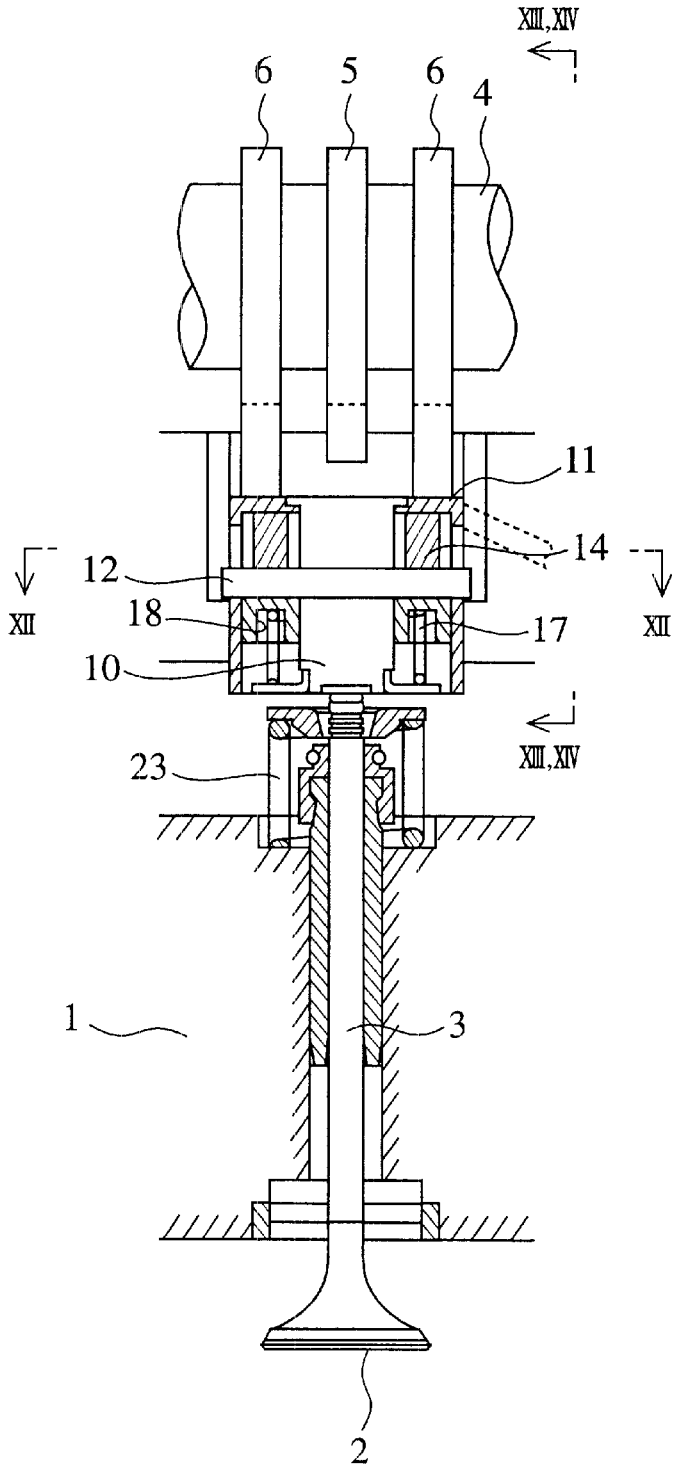
FIG. 10 is a longitudinal cross sectional view showing a valve lift control device in a high-lift mode.
Figure 13A:
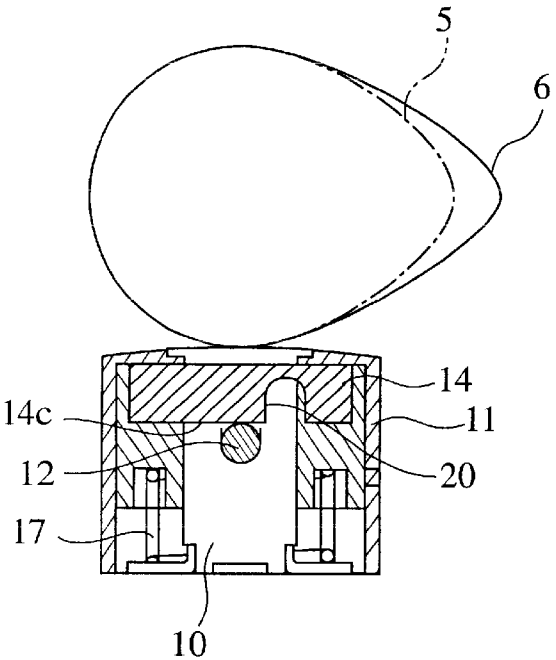
FIG. 13(*a*) to FIG. 13(*c*) and FIG. 14(*a*) to FIG. 14(*c*) are cross sectional views taken along lines XIII—XIII and XIV—XIV of FIG. 10, respectively, each showing a relative position between a cam in a high-lift mode and a tappet with time.
Figure 13B:
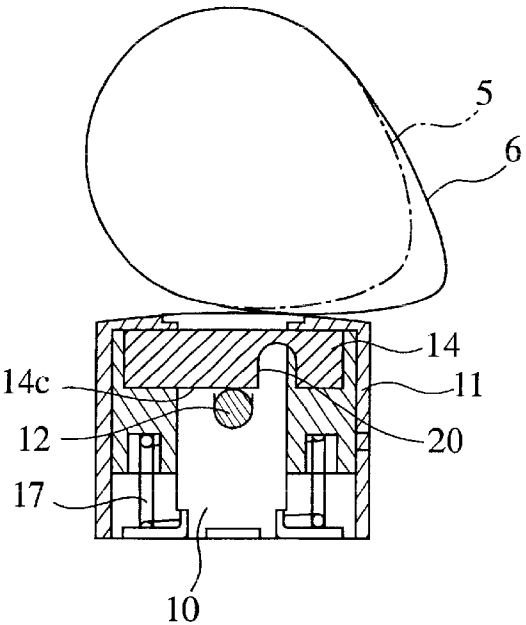
Figure 13C:
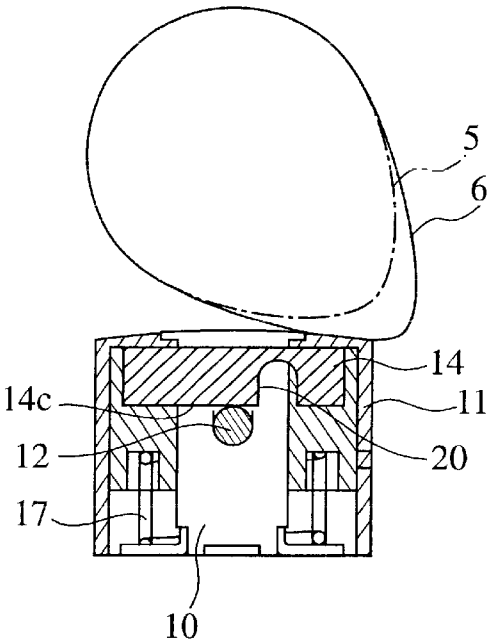

FIG. 1 is a longitudinal cross sectional view showing a relation of a cam and a tappet in a valve lift control device as embodiment 1 according to the invention when a base circle of the cam comes into contact with the tappet. FIG. 2 is a plane view of the valve lift control device as shown in FIG. 1. FIG. 3 is a cross sectional view taken along lines IV—IV of FIG. 1. FIG. 4 is a perspective view showing the valve lift control device as shown in FIG. 1 to FIG. 3. FIG. 5 is an exploded perspective view of FIG. 4. FIG. 6(*a*) to FIG. 6(*c*) and FIG. 7(*a*) to FIG. 7(*c*) are cross sectional views taken along lines VI—VI and VII—VII of FIG. 1, respectively, each showing a relative position between a cam in a low-lift mode and a tappet with time. FIG. 8 is a longitudinal cross sectional view showing a valve-lifted state pursuant to a cam profile of a low-lift cam. FIG. 9 is a perspective view showing the valve lift control device as shown in FIG. 8. FIG. 10 is a longitudinal cross sectional view showing a valve lift control device in a high-lift mode. FIG. 11 is a perspective view showing the valve lift control device as shown in FIG. 10. FIG. 12 is a cross sectional view taken along lines XII—XII of FIG. 10. FIG. 13(*a*) to FIG. 13(*c*) and FIG. 14(*a*) to FIG. 14(*c*) are cross sectional views taken along lines XIII—XIII and XIV—XIV of FIG. 10, respectively, each showing a relative position between a cam in a high-lift mode and a tappet with time. Moreover, in the drawings, for reasons of expediency, a camshaft side is defined as an upper side, and a valve side is defined as a lower side.

In the drawings, a reference numeral 1 denotes a cylinder head of an internal combustion engine (not shown), and a reference numeral 2 denotes an intake valve or an exhaust valve (hereafter, referred briefly as a valve) arranged at the cylinder head 1. A reference numeral 3 denotes a valve rod supporting the valve 2, and a reference numeral 4 denotes a camshaft driven rotationally in synchronization with a rotation of the internal combustion engine. A reference numeral 5 denotes a low-lift cam fixed on the camshaft 4 and used for controlling a valve lift in a low-lift mode corresponding to a low-rpm condition of the internal combustion engine. A reference numeral 6 denotes a pair of high-lift cams fixed on both sides of the low-lift cam 5 fixed on the camshaft 4 and used for controlling a valve lift in a high-lift mode corresponding to a high-rpm condition of the internal combustion engine. A reference numeral 7 denotes a base circle having a circular cross-sectional shape and used as the reference of the low-lift cam 5 and the high-lift cam 6. A cam profile of the low-lift cam 5 has a first bump section 8 formed at a part of the base circle 7. A cam profile of the high-lift cam 6 has a second bump section 9 formed at a part of the base circle 7 and larger than the first bump section 8.

A reference numeral 10 denotes an inner tappet movable reciprocally in an axial direction of the valve rod 3. The inner tappet 10 is a cylindrical member in general including a disc top section 10*a*, which comes into contact with the cam profile of the high-lift cam 6, and a body section 10*b* having a smaller diameter than the top section 10*a*. A through-hole 10*c* allowing occupancy of a rod-shaped member discussed later is formed at an outer periphery of the inner tappet 10 so as to be symmetrical about the midpoint of the axis of the inner tappet 10. An outer tappet 11 is co-axially arranged outside of the inner tappet 10, and movable reciprocally in the axial direction of the valve rod 3. The outer tappet 11 is a cylindrical member in general. The outer tappet 11 includes a central accommodation hole 11*a* accommodating the inner tappet 10 therein, a ring-shaped upper face 11*b* enclosing the central accommodation hole 11*a* and coming into contact with the cam profile of the low-lift cam 5, and a lower opening section 11*c*. The outer tappet 11 is accommodated slidably in a cylindrical hole 1*a* of the cylinder head 1. A pair of through-holes 11*d* is formed at an outer periphery of the outer tappet 11, allowing occupancy of a pin discussed later in a state of projecting outwardly ends of the pin from the through holes 11*c* in association with the through hole 10*c* of the inner tappet 10. The through-hole 11*d* of the outer tappet 11 has a cross sectional profile as distinct from the through-hole 10*c* of the inner tappet 10, the profile being long in an axial direction of the valve rod 3. A length of the profile is identical to a lift-stroke between the low-lift cam 5 and the high-lift cam 6. A hydraulic supply port 11*e* being connected with a hydraulic port discussed later is formed at the outer periphery of the outer tappet 11. A reference numeral 12 denotes a pin acting as a rod-shaped member penetrating the through-hole 10*c* of the inner tappet 10 and the through-hole lid of the outer tappet 11 to protect a relative rotation between both of tappets.

A reference numeral 13 denotes a case having a cylindrical shape in general, the case being co-axially accommodated from the lower opening section 11*c* in the outer tappet 11 in order to arrange a rotational member discussed later in a place between the case 13 and the outer tappet 11. The case 13 has an upper-opening structure having no upper wall and being the reverse equivalent of the outer tappet 11. A selection vane-accommodation groove 15 is constituted by an outer peripheral wall 13*a*, an inner peripheral wall 13*b* disposed inside of the outer peripheral wall 13*a,* and an intermediate bottom 13*c* defined between the both of the walls. A communication wall 13*d* communicating the outer peripheral wall 13*a* with the inner peripheral wall 13*b* is formed so as to extend inwardly from a part of the outer peripheral wall 13*a* in a radial direction of the case 13. A pin-accommodation groove 16 allowing occupancy of a pin 12 is formed at the case 13, the pin 12 passing through a center of the case 13 to cross over the selection vane-accommodation groove 15. The pin-accommodation groove 16 has a cross sectional profile, which is long in the axial direction of the valve rod 3. A bottom of the pin-accommodation groove 16 is formed to be deeper than the intermediate bottom 13*c* constituting the selection vane-accommodation groove 15. A hydraulic supply port 13*e* supplying the hydraulic pressure of one side of the communication wall 13*d* to the selection vane-accommodation groove 15 is arranged at an outer periphery of the case 13. A ring-shaped spring-accommodation groove 18 allowing occupancy of a spring 17 discussed later is formed at the intermediate bottom 13*c* of the case 13 as shown in FIG. 1.

A selection vane 14 acting as a rotational member is accommodated in the selection vane-accommodation groove 15 of the case 13 as shown in FIG. 6. The selection vane 14 has a profile that a part of doughnut-shaped member is cut off. One end 14*a* of the selection vane 14 allows approaching one side of the communication wall 13*d.* A return spring 19 is arranged between the other end 14*b* of the selection vane 14 and the other side of the communication wall 13*d,* the return spring 19 acting as a coil spring biasing acting as a coil spring biasing both sides to keep both sides separated. A pair of recesses 20 allowing occupancy of the pin 12 as a means connecting the inner tappet 10 with the outer tappet 11 is formed at a lower edge 14*c* of the selection vane 14 to be symmetrical about the midpoint of the axis of the selection vane 14.

The body section 10*b* of the inner tappet 10 is co-axially accommodated inside of the inner peripheral wall 13*b* of the case 13 and the inner tappet 10 is reciprocally movable in the axial direction of the valve rod 3. A circular-shaped holding plate 21 is fixedly arranged at a lower edge of the body section 10*b* of the inner tappet 10. A shim 22 acting as a gap-adjustment member adjusting a gap between the cam profile and the tappet is fixedly arranged at a center of the bottom of the body section 10*b.* The spring 17 is arranged in a space between the lower side of the intermediate bottom 13*c* of the case 13 and the holding plate 21 fixed at the inner tappet 10. The spring 17 allows following an operation of the high-lift cam 6 due to the outer tappet 11 when the internal combustion engine (not shown) is operated at a low-rpm, and prevents the occurrence of an abnormal condition.

A spring 23 is arranged between a circular-shaped holding plate 3*a* arranged at the upper end of the valve rod 3 and a spring-receiving face 1*b* of the cylinder head 1 as shown in FIG. 1. The spring 23 biases the valve rod 3 toward closing the valve 2 arranged fixedly at the lower end of the valve rod 3 at all times. In this way, only the inner tappet 10 connected co-axially with the valve rod 3 or the outer tappet 11 integral with the inner tappet 10 can come into contact with the low-lift cam 5 or the high-lift cam 6 which is located above. In FIG. 2, a reference numeral 24 denotes a hydraulic port arranged within the cylinder head 1. The hydraulic port 24 supplies a hydraulic pressure of an oil pump (not shown) to a space, which is defined between the one end 14*a* of the selection vane 14 accommodated in the selection vane-accommodation groove 15 and the communication wall 13*d,* via the hydraulic supply port 11*e* of the outer tappet 11 and the hydraulic supply port 13*e* of the case 13. A pair of rotation-protection grooves 25 is formed at mutual facing positions of an inner periphery of the cylindrical hole 1*a* of the cylinder head 1. The grooves 25 are engaged with the front end of the pin 12, which is projected from the through-hole 11*d* of the outer tappet 11, to control a free rotation of the outer tappet 11 and the inner tappet 10 in the cylindrical hole 1*a.*

Next, an operation will be described.

First, when the internal combustion engine (not shown) is operated at the low-rpm, the end 14*b* of the selection vane 14 is pressed along the selection vane-accommodation groove 15 of the case 13 due to a biasing force of the return spring 19 based on a control signal from a control device (not shown) as shown in FIG. 3. In this way, the selection vane 14 is rotated in a peripheral direction of the case 13 until the end 14*a* of the selection vane 14 comes into contact with one side of the communication wall 13*d.* In such a state of rotation, the recess 20 of the selection vane 14 is located above the pin accommodation groove 16 of the case 13, and the pin 12 arranged in the pin accommodation groove 16 is movable reciprocally between the recess 20 and the pin accommodation groove 16. In this case, the selection vane 14 allows the relative movement of the inner tappet 10 and the outer tappet 11 within the range of movement of the pin 12.

Here, as shown in FIG. 6(*a*), the base circle 7 of the cam profile of the low-lift cam 5 comes into contact with the top section 10*a* of the inner tappet 10. On the other hand, the base circle 7 of the cam profile of the high-lift cam 6 comes into contact with the upper face 11*b* of the outer tappet 11.

Figure 7A:
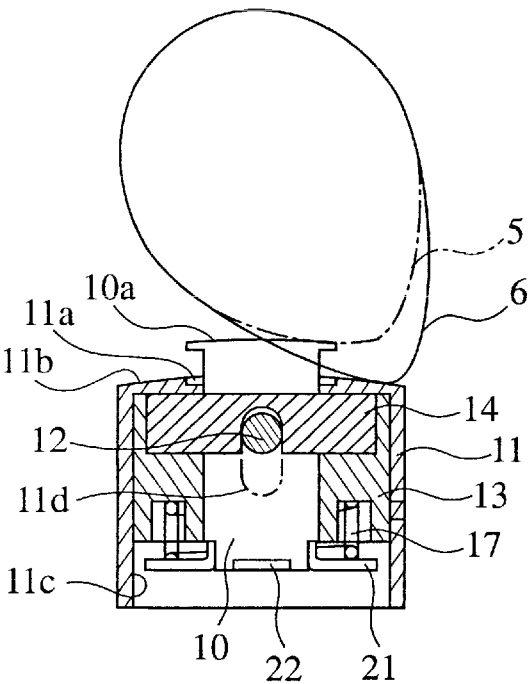
Figure 7B:
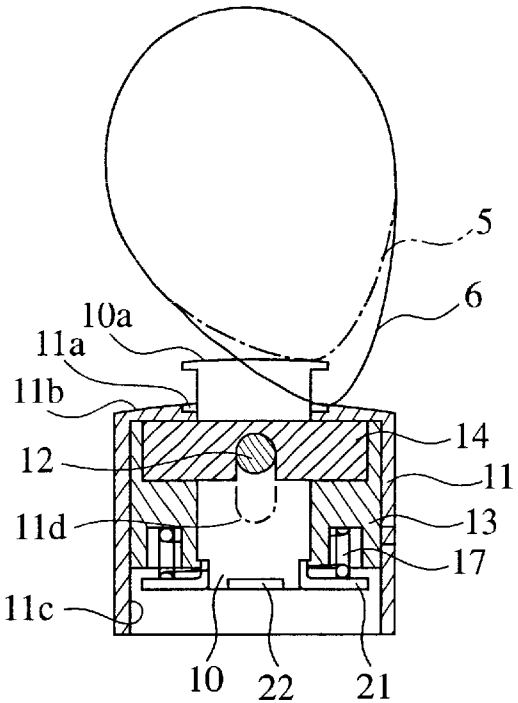
Figure 7C:
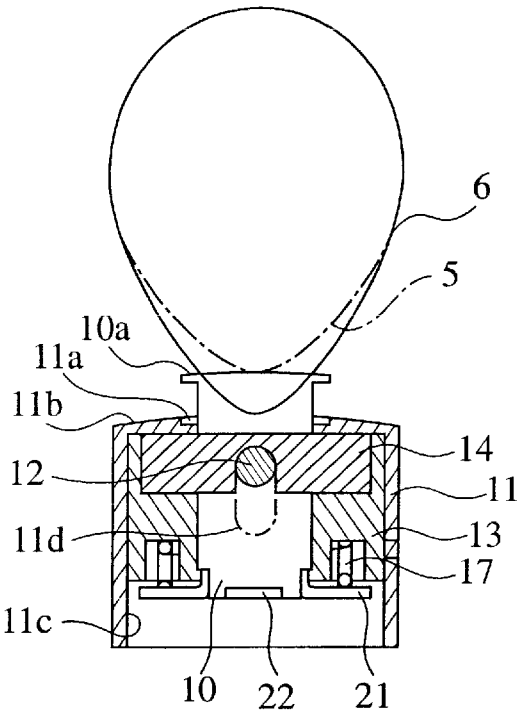

Next, as shown in FIG. 6(*b*), FIG. 6(*c*) and FIG. 7(*a*) to FIG. 7(*c*), when the camshaft 4 is rotated, the cam profile of the low-lift cam 5 is slid over the top section 10*a* of the inner tappet 10. On the other hand, when the camshaft 4 is rotated, the cam profile of the high-lift cam 6 is slid over the upper face 11*b* of the outer tappet 11.

Here, the inner tappet 10 gradually moves upward pursuant to the cam profile of the low-lift cam 5 with respect to the outer tappet 11 by a differential lift-stroke defined between the cam profiles of cams 5 and 6. On the other hand, the outer tappet 11 gradually moves downward pursuant to the cam profile of the high-lift cam 6 with respect to the inner tappet 10. That is, as shown in FIG. 8 and FIG. 9, the lift-stroke produced due to the cam profile of the high-lift cam 6 is absorbed by the spring 17 at the low-rpm. In this way, the valve 2 is opened by the lift-stroke pursuant to the cam profile of the low-lift cam 5.

Next, when the internal combustion engine (not shown) is operated at the high-rpm, a state shown in FIG. 3 is changed to a state shown in FIG. 11 and FIG. 12 based on a control signal from a control device (not shown). In other words, a hydraulic pressure is supplied from the hydraulic port 24 to a space, which is defined between the one end 14*a* of the selection vane 14 accommodated in the selection vane-accommodation groove 15 and the communication wall 13*d,* via the hydraulic supply port 11*e* of the outer tappet 11 and the hydraulic supply port 13*e* of the case 13. In this way, the selection vane 14 is rotated against the biasing force of the return spring 19 in a direction (indicated by an arrow A) of the peripheral directions of the case 13 in the selection vane-accommodation groove 15, and the end 14*b* of the selection vane 14 is close to the other side of the communication wall 13*d.* At this time, a part of the outer periphery of the rod 12*b* of the pin 12 deviates from the recess 20 of the selection vane 14, and comes into contact with the lower edge 14*c* of the selection vane 14. In such a state, the selection vane 14 locks the inner tappet 10 and the outer tappet 11 using the pin 12 in order to integrate the inner tappet 10 with the outer tappet 11.

Figure 14A:
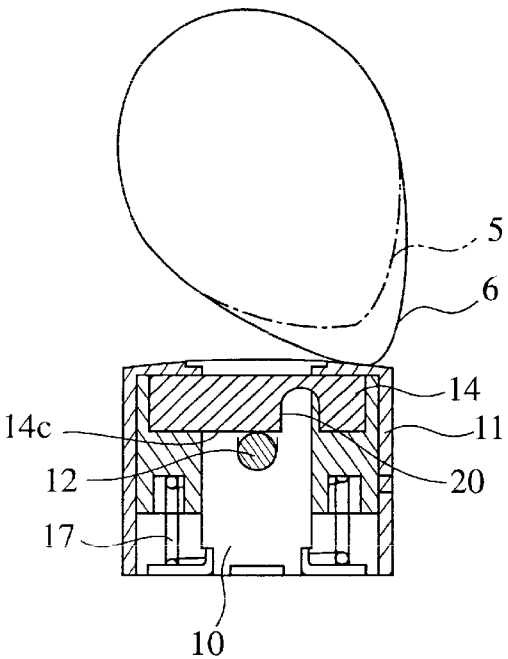
Figure 14B:
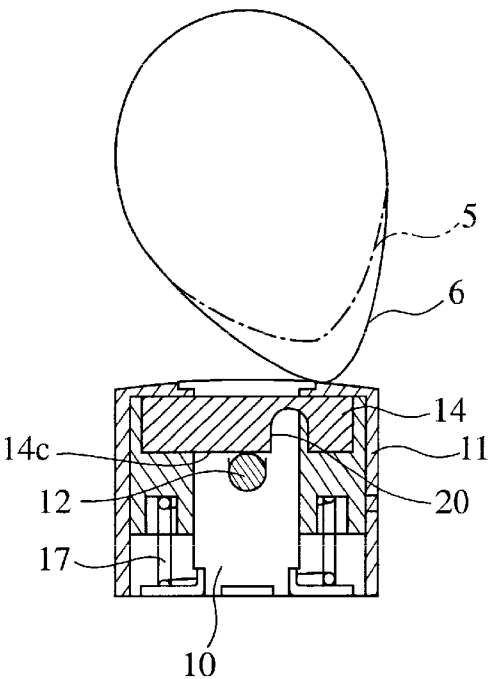
Figure 14C:
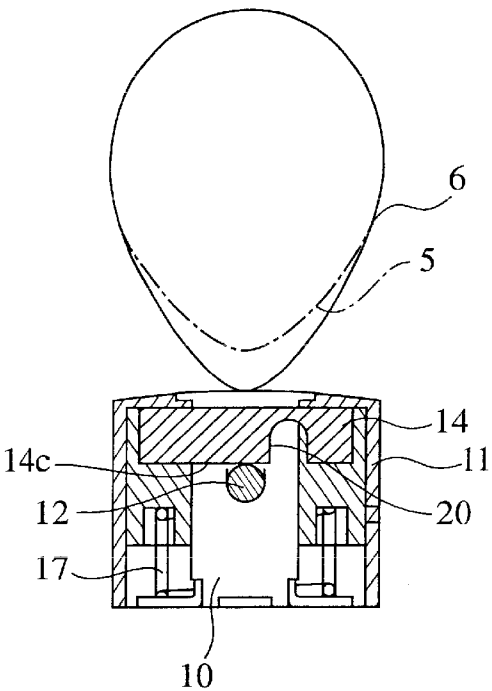

Next, when the camshaft 4 is rotated as shown in FIG. 13(*a*) to FIG. 13(*c*) and FIG. 14(*a*) to FIG. 14(*c*), the inner tappet 10 is not operated pursuant to the cam profile of the low-lift cam 5 because the inner tappet 10 is integral with the outer tappet 11. The inner tappet 10 and the outer tappet 11 are operated pursuant to the cam profile of the high-lift cam 6. That is, as shown in FIG. 10, the cam profile of the low-lift cam 5 is not transmitted to the inner tappet 10, and the valve 2 is opened by the lift-stroke pursuant to the cam profile of the high-lift cam 6.

Next, when a high-rpm operation of the internal combustion engine (not shown) is changed to a low-rpm operation, a hydraulic pressure supplied to the selection vane-accommodation groove 15 is reduced. The selection vane 14 is further rotated due to the biasing force of the return spring 19 in the other direction (inverted direction arrow A of FIG. 12) of the peripheral directions of the case 13. The one end 14*a* of the selection vane 14 then comes into contact with the other side of the communication wall 13*d*. As shown in FIG. 6(*a*), the recess 20 of the selection vane 14 and the pin 12 are arranged in the axial directions of the tappets 10 and 11 to return the tappets 10 and 11 to a state of allowing sliding of the tappets in the axial directions.

As described above, according to the embodiment 1, since the pin 12 acting as the rod-shaped member and the selection vane 14 acting as the rotational member are arranged, the valve lift control device is simply constituted as compared with the conventional valve lift control device. The valve lift control device facilitates selection between a valve lift during a low-rpm condition and a valve lift during a high-rpm condition.

It is therefore possible to ensure good operating reliability and good stability in each parts of the device.

With the embodiment 1, the doughnut-shaped member having a cut-off portion is used as the selection vane 14. Alternatively, at least one fan-shaped member may be used as the selection vane 14.

With the embodiment 1, the return spring 19 is used as a coil spring. Alternatively, a torsion-spring may be used as the spring.

With the embodiment 1, the rod 12*b* of the pin 12, which comes into contact with the lower edge 14*c* of the selection vane 14, has the cylindrical shape. A contact face of the rod 12*b* may be formed as a plane face. In this way, it is possible to ensure good stability with respect to contact between the pin 12 and the selection vane 14. In this case, the rod 12*b* may be a T-shaped or rectangular in cross section, and the invention is not limited to these profiles.

With the embodiment 1, the rotation of the selection vane 14 is performed due to an oil pressure as the hydraulic pressure. The hydraulic pressure is not limited to the oil pressure, and every hydraulic transmission medium can be used without any limitation.

Embodiment 2

Figure 15:
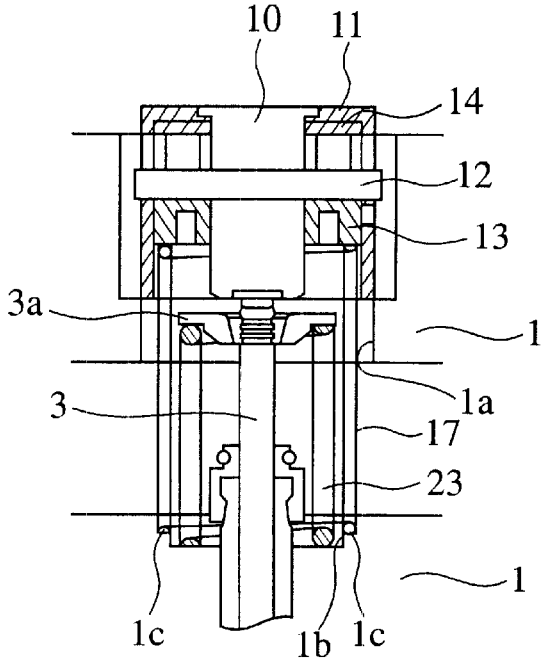
FIG. 15 is a longitudinal cross sectional view showing a valve lift control device as embodiment 2 according to the invention.

FIG. 15 is a longitudinal cross sectional view showing a valve lift control device as embodiment 2 according to the invention. Components of the embodiment 2 common to those of the embodiment 1 are denoted by the same reference numerals and further description will be omitted.

The embodiment 2 is characterized in that a spring-receiving face 1*c* is co-axially arranged outside the spring-receiving face 1*b* of the cylinder head 1. Moreover, a tolerance space having a distance for stroke of the spring 17 longer than the embodiment 1 is defined between the spring-receiving face 1*c* and the bottom of the case 13 and the spring 17 having a diameter than larger than the embodiment 1 is arranged within the tolerance space.

With the embodiment 1, the spring 17 produces an insufficient load in the tolerance space, and there is a possibility the outer tappet 11 is surged. On the other hand, as shown in FIG. 15, the spring 17 of the embodiment 2 is arranged in the tolerance space having the distance for stroke of the spring 17 longer than the embodiment 1. With the embodiment 2, the spring 17 therefore produces a sufficient load in the tolerance space, and it is possible to prevent the outer tappet 11 from surging.

Embodiment 3

Figure 16:
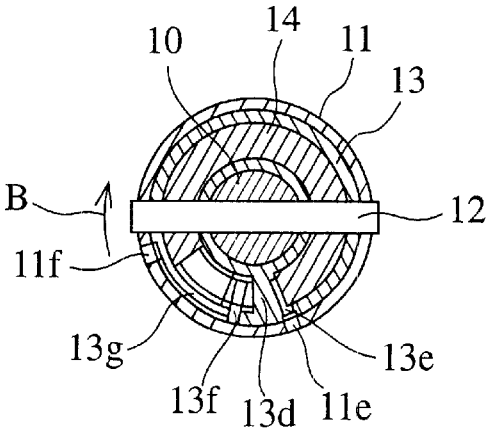
FIG. 16 is a lateral cross sectional view showing a valve lift control device as embodiment 3 according to the invention.

FIG. 16 is a lateral cross sectional view showing a valve lift control device as embodiment 3 according to the invention. Components of the embodiment 3 common to those of the embodiment 1 are denoted by the same reference numerals and further description will be omitted.

The embodiment 3 is characterized in that a hydraulic pressure is used for rotating the selection vane 14 in a direction indicated by an arrow B in conjunction with the biasing force of the return spring 19. The return spring 19 is used when the high-rpm operation of the internal combustion engine (not shown) is changed to the low-rpm operation with the embodiment 1. That is, as shown in FIG. 16, a second hydraulic supply port 11*f* is arranged at the outer periphery of the outer tappet 11. A second hydraulic supply port 13*f*, which communicates with the selection vane-accommodation groove 15 positioned at the other side of the communication wall 13*d*, is arranged at the outer periphery of the case 13. A hydraulic supply passage 13*g* is arranged between the second hydraulic supply port 13*f* and the outer periphery of the case 13, which corresponds to the second hydraulic supply port 11*f* of the outer tappet 11.

As described above, according to the embodiment 3, the selection vane 14, which is rotated due to the mechanical biasing force and the hydraulic pressure, is used as a component. It is possible to lock smoothly the pin 12 due to the selection vane 14 and release smoothly the lock of the pin 12. Even if the hydraulic pressure is not supplied accidentally due to the occurrence of some event, it is possible to switch safely between locking and releasing due to the mechanical biasing force.

Embodiment 4

Figure 17:
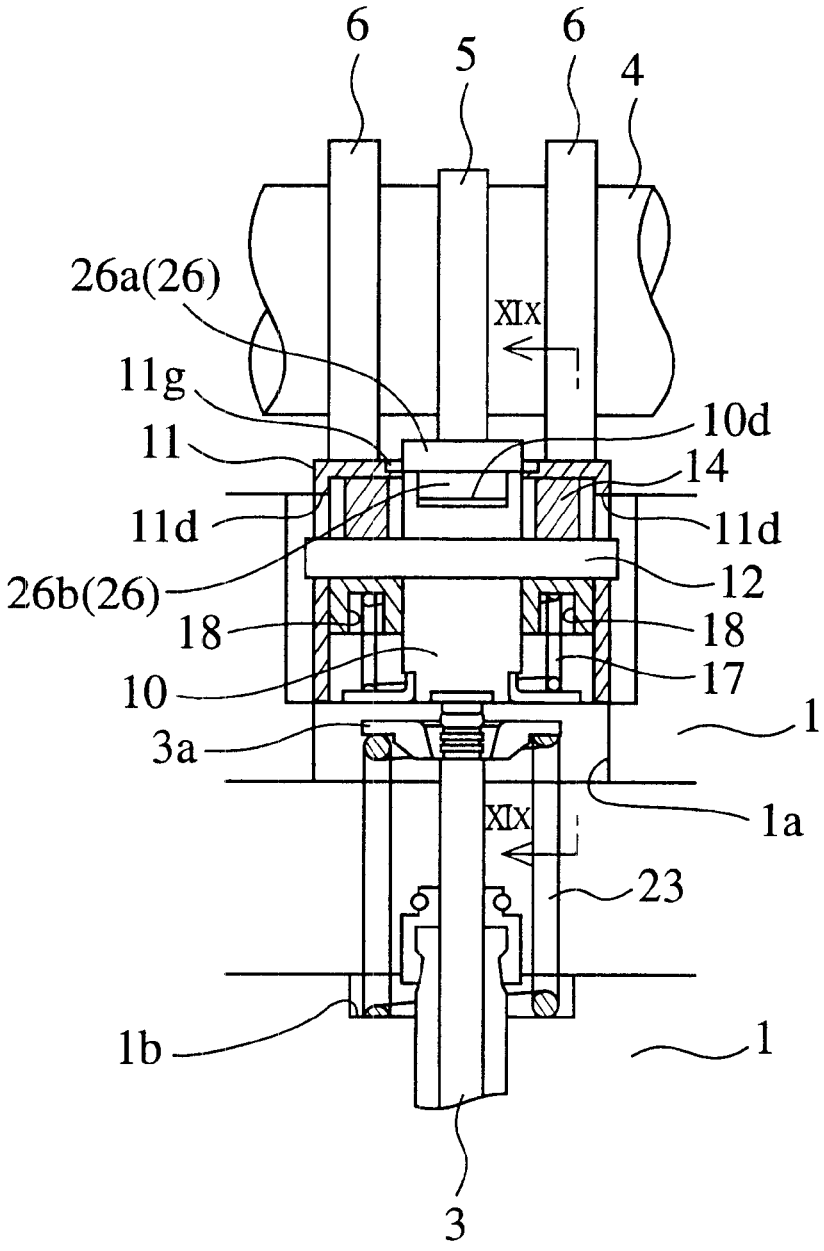
FIG. 17 is a longitudinal cross sectional view showing a valve lift control device as embodiment 4 according to the invention.
Figure 18:
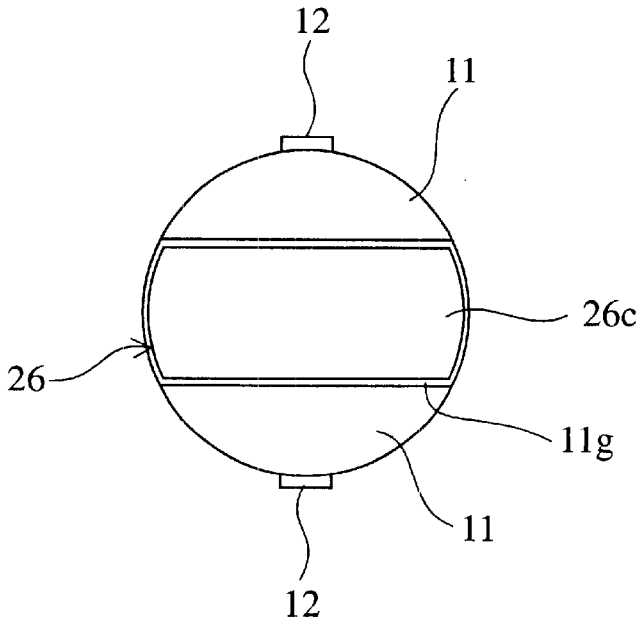
FIG. 18 is a plane view showing a valve lift control device as shown in FIG. 17.
Figure 19:
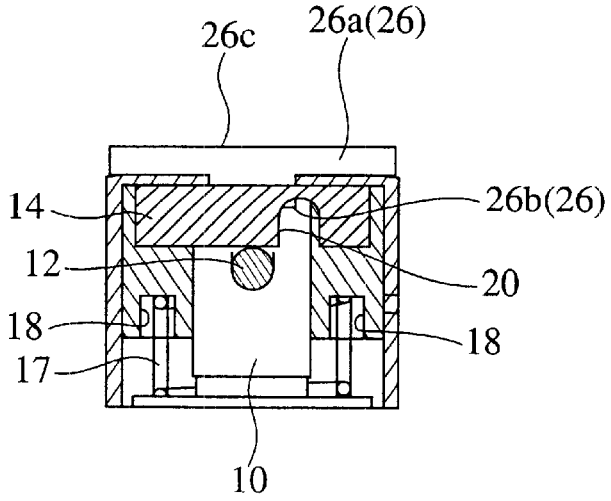
FIG. 19 is a cross sectional view taken along lines XIX—XIX of FIG. 18.

FIG. 17 is a longitudinal cross sectional view showing a valve lift control device as embodiment 4 according to the invention. FIG. 18 is a plane view showing a valve lift control device as shown in FIG. 17. FIG. 19 is a cross sectional view taken along lines XIX—XIX of FIG. 18. Components of the embodiment 4 common to those of the embodiment 1 are denoted by the same reference numerals and further description will be omitted.

The embodiment 4 is characterized in that a peripheral section of the top section 10*a* of the inner tappet 10 is arranged outside the orbit of the cam profile of the low-lift cam 5, apart from the low-lift cam 5.

The arrangement can prevent the cam profile of the low-lift cam 5 from coming into contact with the peripheral section of the top section 10*a* at the maximum lift-stroke of the low-lift cam 5.

That is, with the embodiment 4, a guide shim 26 acting as the slide-bearing member undergoing a sliding of the low-lift cam 5 is mounted detachably at an upper section of the inner tappet 10 as shown in FIG. 17 to FIG. 19. The guide shim 26 includes a sliding section 26*a* formed in parallel to the orbital face of the cam profile of the low-lift cam 5 and extending in a direction orthogonal to the axial direction of the camshaft 4, and a base section 26*b* formed at a central lower side of the sliding section 26*a* and mated with a recess 10*d* formed at the upper section of the inner tappet 10 in place of the top section 10*a*. An upper face of the sliding section 26*a* is defined as a sliding face 26*c* undergoing a sliding of the low-lift cam 5, and the sliding face 26*c* has a rectangular shape extending in a direction orthogonal to the axial direction of the camshaft 4. In this way, since a lateral edge of the sliding face 26*c* is located outside the orbit of the cam profile of the low-lift cam 5, it is possible to prevent the lateral edge of the sliding face 26*c* from coming into contact with the low-lift cam 5.

With the embodiment 4, it is possible to prevent the low-lift cam 5 from coming into contact with the peripheral section of the top section 10*a* of the inner tappet 10, and to ensure a smooth sliding of the low-lift cam 5 with respect to the inner tappet 10.

With the embodiment 4, the lower section of the sliding section 26*a* of the guide shim 26 is accommodated in an accommodation groove 11*g* formed at the upper face 11*b* of the outer tappet 11. A portion, which is apart from a contact face undergoing a sliding of the high-lift cam 6, in the upper face 11*b* of the outer tappet 11 is substantially covered with the lower section of the sliding section 26*a*. In this case, when the guide shim 26 is rotated on the orbit of the high-lift cam due to the occurrence of some event, it is impossible to perform the smooth sliding of the low-lift cam. Members such as Pins, keys and so on, or technique such as spline, serration and so on are used as a rotational location control means in order to prevent the smooth sliding. However, the invention is not limited to the rotational location control means above.

With the embodiment 4, the sliding face 26*c* of the guide shim 26 is projected upwardly from the upper face 11*b* of the outer tappet 11. In this case, a thickness of the sliding section 26*a* is available to a feature in which the base circle diameter of the high-lift cam is different from that of the low-lift cam. The sliding section 26*a* can therefore have a high degree of flexibility in thickness.

Embodiment 5

Figure 20:
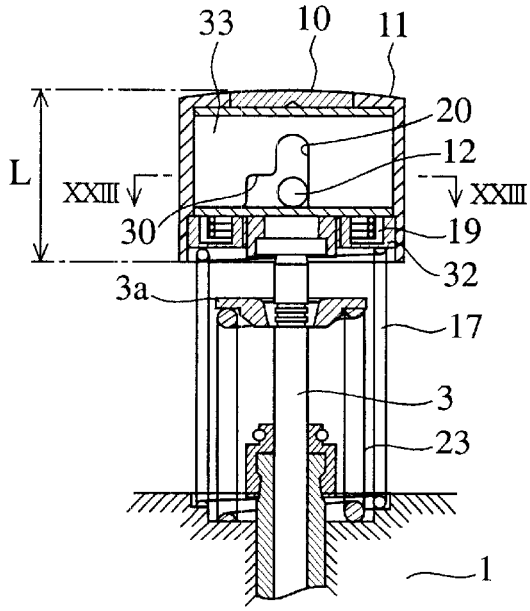
FIG. 20 is a cross sectional view showing a rotational member in a valve lift control device as embodiment 5 according to the invention.
Figure 21:
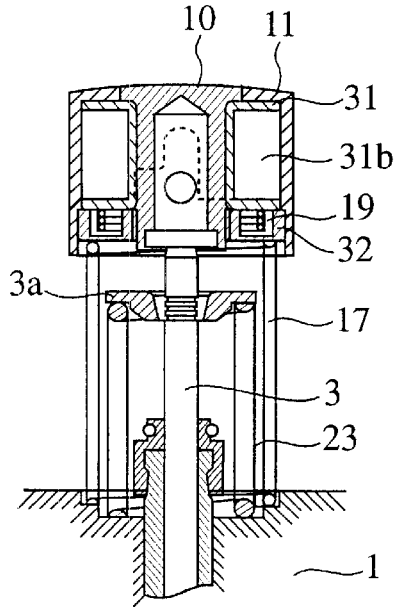
FIG. 21 is a cross sectional view showing a holder allowing rotation of the rotational member as shown in FIG. 20.
Figure 22:
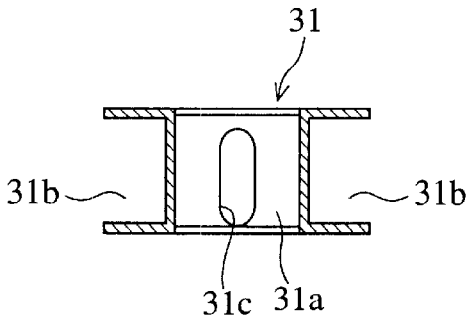
FIG. 22 is an enlarged cross sectional view showing the holder as shown in FIG. 21.
Figure 23:
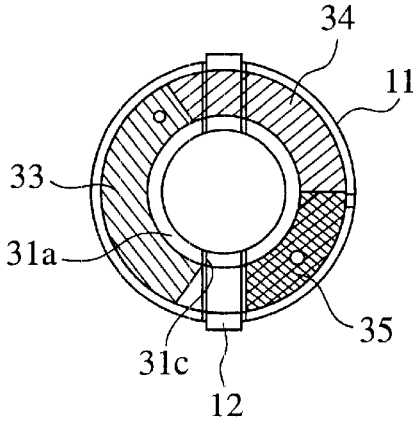
FIG. 23 is a cross sectional view taken along lines XXIII—XXIII of FIG. 20, showing the rotational member and the projection member released in the valve lift control device shown in FIG. 20.
Figure 24:
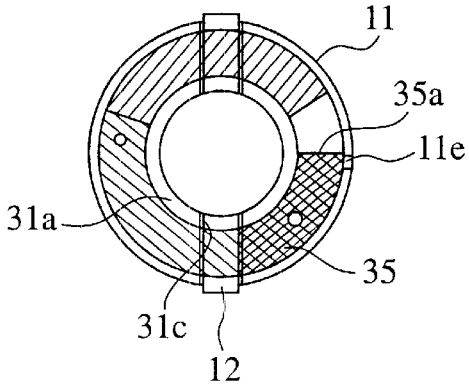
FIG. 24 is a cross sectional view showing the rotational member and the projection member locked in the valve lift control device shown in FIG. 20.

FIG. 20 is a cross sectional view showing a rotational member in a valve lift control device as embodiment 5 according to the invention. FIG. 21 is a cross sectional view showing a holder allowing rotation of the rotational member as shown in FIG. 20. FIG. 22 is an enlarged cross sectional view showing the holder as shown in FIG. 21. FIG. 23 is a cross sectional view taken along lines XXIII—XXIII of FIG. 20, showing the rotational member and the projection member released in the valve lift control device shown in FIG. 20. FIG. 24 is a cross sectional view showing the rotational member and the projection member locked in the valve lift control device shown in FIG. 20. Components of the embodiment 5 common to those of the embodiment 1 are denoted by the same reference numerals and further description will be omitted.

The embodiment 5 is characterized in that a stopper-pin-receiving face 30, which locks an operation of the pin 12, is arranged at a part of the recess 20 of the rotational member. That is, with the embodiment 1 and so on, the lower edge 14*c* of the selection vane 14 defined as the sliding face of the rotational member functions as a stopper-pin-receiving face. On the other hand, with the embodiment 5, the sliding face and the stopper-pin-receiving face of the rotational member are divided into two ways. In this way, it is possible to ensure good operating reliability.

With the embodiment 5, a holder 31 allowing rotation of the rotational member has a bobbin-shape, which is simple, in consideration of the machinability of the rotational member as shown in FIG. 21 and FIG. 22. The holder 31 includes a cylindrical section 31*a*, a rotational member-accommodation groove 31*b* formed along an outer periphery of the cylindrical section 31*a* to accommodate the rotational member, and a pin-accommodation groove 31*c* extended in an axial direction of the cylindrical section 31*a* to pass through the cylindrical section 31*a*. The cylindrical section 31*a* of the holder 31 accommodates the inner tappet 10 so as to allow sliding of the inner tappet 10 in the axial direction. An U-letter shaped spring retainer 32 in cross section is arranged at a periphery of a bottom of the holder 31. The spring retainer 32 accommodates the return spring 19 acting as the torsion-spring, which biases the rotational member against the hydraulic pressure.

With the embodiment 5, two fan-tailed selection vanes 33 and 34 constitute the rotational member. In this way, an area of a hydraulic pressure undergoing face is larger than that of the embodiment 1 and so on as a length of the tappet is shorten. Therefore, it is possible to ensure a good hydraulic response.

Next, an operation will be described.

First, when the internal combustion engine (not shown) is operated at a low-rpm, as shown in FIG. 23, a hydraulic pressure is not supplied to a space defined between the accommodation groove 31*b* of the holder 31 and the inner wall face of the outer tappet 11. Therefore, the selection vanes 33 and 34 are rotated in a direction indicated by the arrow A due to the biasing force of the return spring 19, and the selection vane 34 comes into contact with one wall face 35*a* of the stopper 35. In such a state, the pin 12 is moved freely within the recess 20 of the selection vane 33 to allow a relative sliding of the inner tappet 10 and the outer tappet 11 in an axial direction of the tappet.

Next, when the internal combustion engine (not shown) is operated at a high-rpm in FIG. 24, a hydraulic pressure is supplied to a space defined between the accommodation groove 31*b* of the holder 31 and the inner wall face of the outer tappet 11 via the hydraulic supply port 11*e*. Therefore, the selection vanes 33 and 34 are rotated in a direction indicated by the arrow B against the biasing force of the return spring 19, and the pin 12 is engaged with the stopper-pin-receiving face 30 formed at a part of the recess 20. In such a state of lock, it is possible to protect a relative rotation between the inner tappet 10 and the outer tappet 11 in the axial direction of the tappet.

As described above, according to the embodiment 5, the stopper-pin receiving face 30 is arranged at a part of the recess 20. Thus, it is not necessary to mount the pin 12 on the sliding face (the lower edge 14*c*) of the rotational member as in the case of the embodiment 1 and so on. In this way, it is possible to shorten a dimension L at least by a length corresponding to a diameter of the pin 12, and to save weight of the valve lift control device.

Moreover, with the embodiment 5, two fan-tailed selection vanes 33 and 34 divided constitute the rotational member. Alternatively, the rotational member may be constituted by a single member or may be divided into three parts or more.

INDUSTRIAL APPLICABILITY

As apparent from the foregoing, when the valve lift control device is used in conjunction with a valve timing control device, the valve lift control device can be controlled effectively as compared with a single use in order to enhance fuel economy and to produce a high-power.

What is claimed is:

1. A valve lift control device, comprising:

an inner tappet biased toward a low-lift cam pertinent to the opening and the closing of a valve in the low-lift mode acting as one of cams which are arranged on a camshaft being driven rotationally in synchronization with a rotation of an internal combustion engine;

an outer tappet arranged outside of the inner tappet and biased toward a high-lift cam pertinent to the opening and the closing of the valve in the high-lift mode among the plurality of cams; and a rotational member being arranged rotationally in a peripheral direction of the inner and outer tappets and including at least one projection member being outwardly projected from a perimeter of the inner tappet and an engagement section engaging with the projection member, characterized in that a relative sliding of the inner and outer tappets in an axial direction of the tappets is blocked or allowed due to a rotation of the rotational member in a required range.

2. A valve lift control device according to claim 1, characterized in that the projection member is a rod-shaped member projected from the outer periphery of the inner tappet.

3. A valve lift control device according to claim 2, characterized in that the rod-shaped member passes through the interior of the inner tappet in a radial direction, and that at least one end of the rod-shaped member is projected outwardly from the perimeter of the inner tappet in the radial direction.

4. A valve lift control device according to claim 1, characterized in that the rotational member is movable in one direction in two peripheral directions of the inner and outer tappets, respectively, due to a hydraulic pressure.

5. A valve lift control device according to claim 4, characterized in that the rotational member is movable in the other direction in two peripheral directions of the inner and outer tappets, respectively, due to a mechanical biasing force.

6. A valve lift control device according to claim 1, characterized in that the rotational member is movable in both peripheral directions of the inner and outer tappets, respectively, due to a hydraulic pressure.

7. A valve lift control device according to claim 1, characterized in that the rotational member has an recess, which is engaged with the projection member.

8. A valve lift control device according to claim 1, characterized in that the projection has a plane face acting as a contact face, which comes into contact with the rotational member.

9. A valve lift control device according to claim 1, characterized in that at least one end of the projection member is projected outwardly from the outer periphery of the inner tappet in a radial direction, and is engaged with a groove formed at an inner face of a cylindrical aperture, which supports slidably the outer tappet, of a cylinder head in a sliding direction.

10. A valve lift control device according to claim 1, characterized in that an edge of a contact face, which comes into contact with the low-lift cam, of the inner tappet is arranged outside of an orbit of a cam profile of the low-lift cam, apart from the low-lift cam.

11. A valve lift control device according to claim 1, characterized in that the rotational member has the shape of a sector, at least one thereof is arranged in a holder having a bobbin-shape, and is held rotationally in peripheral directions of the rotational member.

12. A valve lift control device according to claim 11, characterized in that a stopper controlling a range allowing rotation of the rotational member is arranged at a portion of a groove of the bobbin-shaped holder.

13. A valve lift control device according to claim 11, characterized in that a torsion-spring, which biases the rotational member in one direction of peripheral directions of the inner and outer tappets, is provided.

14. A valve lift control device according to claim 1, characterized in that the inner tappet is provided with a slide-bearing member having a contact face, which comes into contact with the low-lift cam, of the inner tappet and allowing mating with and de-mating from the inner tappet.

15. A valve lift control device according to claim 14, characterized in that the slide-bearing member covers with a portion of the outer tappet apart from a contact face, which comes into contact with the high-lift cam, of the outer tappet.

16. A valve lift control device according to claim 14, characterized in that the slide-bearing member is accommodated in a groove formed at a portion of the outer tappet apart from a contact face, which comes into contact with the high-lift cam, of the outer tappet, wherein a contact face of the slide-bearing member is flush with the contact face of the outer tappet.

17. A valve lift control device, comprising:

an inner tappet biased toward a low-lift cam pertinent to the opening and the closing of a valve in the low-lift mode acting as one of cams which are arranged on a camshaft being driven rotationally in synchronization with a rotation of an internal combustion engine;

an outer tappet arranged outside of the inner tappet and biased toward a high-lift cam pertinent to the opening and the closing of the valve in the high-lift mode among the plurality of cams;

a rod-shaped member allowing the relative sliding between the inner and outer tappets in an axial direction of the tappet within a stroke equivalent to a difference between a valve lift due to the low-lift cam and a valve lift due to the high-lift cam;

a rotational member moving in one direction of peripheral directions of the inner and outer tappets to lock the rod-shaped member and accordingly to move integrally the inner and outer tappets in the axial direction thereof; and a hydraulic mechanism arranged outside of the inner tappet to allow the lock and release of the rod-shaped member due to the rotational member.

* * * * *